US007341363B1

(12) United States Patent
Richardson

(10) Patent No.: US 7,341,363 B1
(45) Date of Patent: Mar. 11, 2008

(54) RETRACTABLE CLAMPING DEVICE FOR LIGHT FIXTURES

(76) Inventor: Brian Edward Richardson, 18675-P Adams Ct., Morgan Hill, CA (US) 95037

( * ) Notice: Subject to any disclaimer, the term of this patent is extended or adjusted under 35 U.S.C. 154(b) by 0 days.

(21) Appl. No.: 11/250,812

(22) Filed: Oct. 14, 2005

(51) Int. Cl.
*F21V 21/08* (2006.01)

(52) U.S. Cl. ..... 362/396; 362/388; 362/418; 362/419; 362/422; 362/433

(58) Field of Classification Search ..... 362/396, 362/418, 419, 422, 433, 388, 391, 323, 324; 248/323, 324
See application file for complete search history.

(56) References Cited

U.S. PATENT DOCUMENTS

| | | | | |
|---|---|---|---|---|
| 1,483,588 | A * | 2/1924 | Meyers et al. | 248/231.51 |
| 2,088,812 | A * | 8/1937 | Reichenbach | 248/682 |
| 2,455,444 | A * | 12/1948 | Schwartz | 248/230.7 |
| 2003/0086273 | A1 * | 5/2003 | Canuel | 362/419 |

* cited by examiner

*Primary Examiner*—Stephen F Husar
*Assistant Examiner*—Meghan K. Dunwiddie
(74) *Attorney, Agent, or Firm*—The Kline Law Firm

(57) ABSTRACT

A clamping device to hang lighting fixtures includes a hinge mechanism that enables the device to be folded out of the way for storage or for floor or ground use. The clamping device may include foot pads to add stability to the support of the lighting fixture. A curved portion of the main body of the device allows the clamp to secure lighting fixtures to an overhead pipe or rail.

7 Claims, 5 Drawing Sheets

RETRACTABLE CLAMPING DEVICE FOR LIGHT FIXTURES

BACKGROUND OF THE INVENTION

1. Field of the Invention

The present invention relates generally to entertainment lighting, and more specifically is a device used to mount lighting fixtures during productions and for storage.

2. Description of the Prior Art

The type of light fixture mounting device that is the subject of the present invention is used in theatrical, musical, television, and other productions that require rented lighting fixtures. Many productions require lighting fixtures to be hung from a pipe or to sit on the floor of the stage or set piece. When the production is over, which may be days or months, these fixtures are typically packed into a road case to protect them during shipment. When these lighting fixtures are returned to the rental house they are usually unpacked, tested, and re-packed. This testing is done in either the hanging or floor orientation. In a typical hanging configuration, one or two clamping devices are mounted to the fixture before it can be hung. These clamps must be removed if the fixture is to be located on the floor. The time spent removing and assembling these clamping devices can add up to a considerable amount when there are hundreds of lights used in a show. Some shows travel to a new city every day or two. In these cases removing and assembling clamps adds up to a substantial cost.

Cases made for transportation are often fabricated to be tall enough to accommodate both the fixture and the clamping device. This requires that the case be much larger than actually required. With some shows that travel day after day all over the country and the world the extra cost for this wasted space is substantial.

Examples of prior art clamping devices are disclosed in U.S. Pat. No. D457,410, issued May 21, 2002, "A Lighting Clamp", and U.S. Pat. No. D453,671, issued Feb. 19, 2002, "A Lighting Clamp", both by VanFange. Both of these clamps disclose the state of the art for lighting fixture clamping devices. They do a very good job of quickly securing a lighting fixture to a truss or pipe. The clamps typically require a bolt to fasten them to a lighting fixture. Tightening the bolts can take a lot of time if there are a many fixtures used in a production, or if the production is often moved from location to location. Further, if the bolts remain on the fixture during transportation in a case, the bolts take up a significant amount of space, sometimes up to an additional 20% of space.

Prior art lighting fixtures that could make use of the clamping devices disclosed by VanFange are disclosed in U.S. Pat. No. 5,590,955 by Bornhorst, "Variable Light Modifier ", issued Sep. 24, 2002.

A prior art trunk that would be used to transport lighting fixtures with clamps is disclosed by Bornhorst in U.S. Pat. No. D347,113, "Storage and transportation trunk".

Accordingly, it is an object of the present invention to provide a mounting device that is always fastened to the lighting fixture, whether the fixture is hung from an overhead location or is located on the floor.

It is another object of the present invention to provide a lighting fixture mounting device that allows for the fixture to be hung on a pipe for a production while requiring little space when not in use.

It is a further object of the present invention to provide a sturdy base when the lighting fixture is being used on the floor.

A further object of the present invention is to provide a lighting fixture mounting device that takes up little room when the lighting fixture is stored or is placed in a protective case.

SUMMARY OF THE INVENTION

The present invention is a device to hang a lighting fixture from a pipe or truss member, or to support the fixture on the ground. The clamp portion of the device is hinged. The hinge allows the mounting device to fold out of the way so the entire assembly can be stored more compactly and so it can remain attached to a lighting fixture when the fixture is used on the floor.

DETAILED DESCRIPTION OF THE INVENTION

Figure 1:
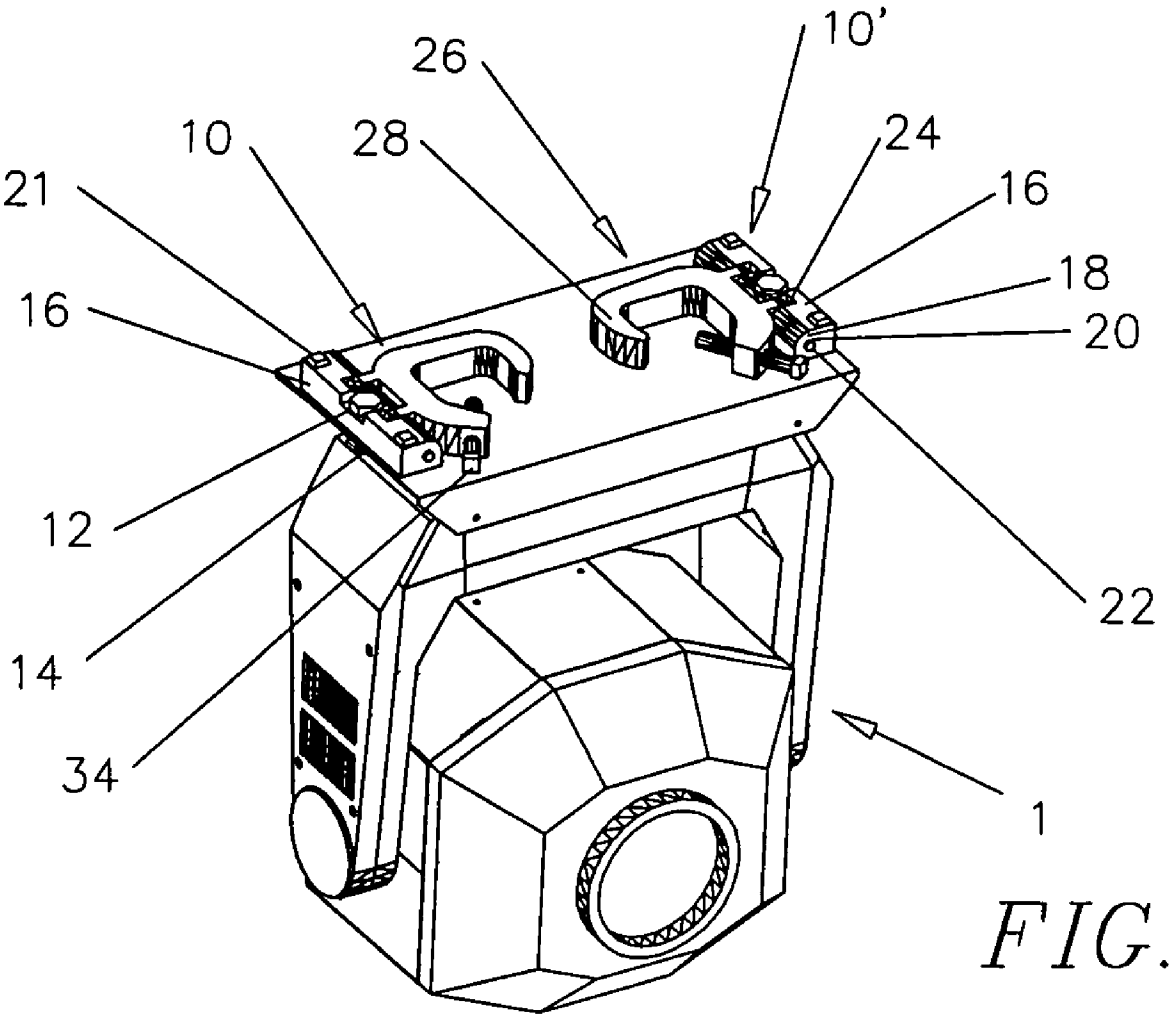
FIG. 1 is a perspective view of the present invention attached to an automated lighting fixture.

Referring first to FIG. 1, the present invention is a clamping device to hang a lighting fixture 1. The lighting fixture 1 is shown with two of the clamping devices attached. A left side clamping device 10 is attached to the left side of the fixture 1, and a right side clamping device 10' is attached to the right side of the fixture 1. The right side clamping device 10' is a mirror of the left side clamping device 10. A bolt 12 and a nut 14 fasten the clamping device 10, 10' to the mounting holes (not shown) of the lighting fixture 1.

A multiple section base 16 of the clamping device 10, 10' comprises a plurality of bosses 18 that project inward from the base 16. Foot pads 21 are situated on the bosses 18 to support the clamps and lighting fixture when used in a floor mount application. A through hole 20 in a center of each of the bosses 18 receives a pivot axle 22. A slot 24 is formed between each section of the base 16, each slot 24 receiving a clamp member 26 that extends from a C-shaped main body 28 of the clamping device 10, 10'. Each of the clamp members 26 includes a through hole 30 hole that is concentric with the through holes 20 in the bosses 18. The pivot axle 22 passes through the through holes 20 in the base and the through holes 30 holes in the clamp member 26. The above described hinge mechanism forms a structure that allows the clamp member to be rotated from a horizontal position as shown in FIG. 1 through an angle of 90 degrees to a vertical position illustrated in FIG. 2.

Figure 2:
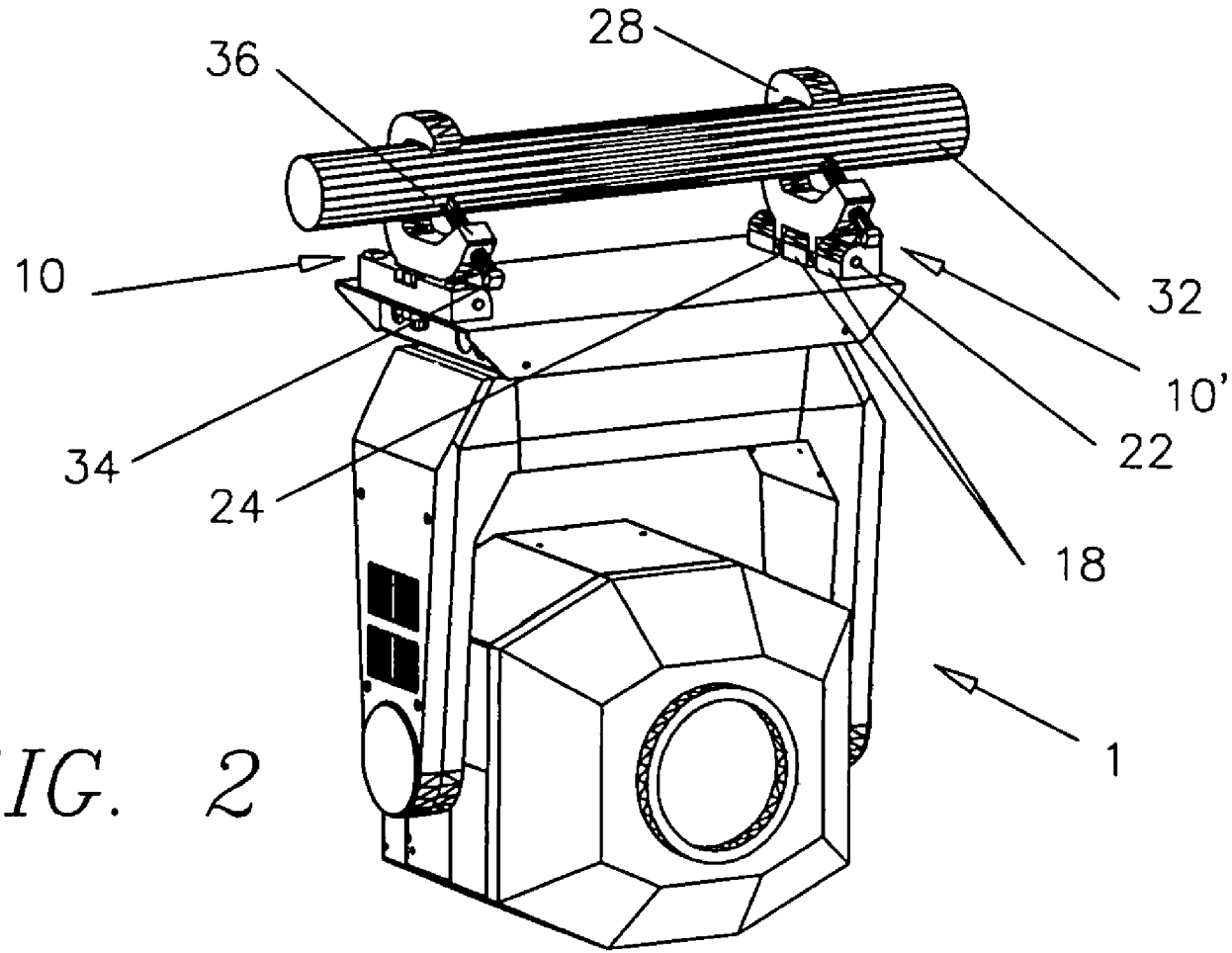
FIG. 2 is a perspective view of the present invention attached to an automated light hanging from a pipe.

Referring now chiefly to FIG. 2, with the clamping devices 10, 10' in the vertical position, an upper end of the main body 28 of the clamping device 10, 10' is affixed to a pipe 32 to hang the lighting fixture 1. A securing means such as a set screw 34 is mounted on a lower end 36 of the main body 28 of each clamping device 10, 10'. The set screw 34 allows the clamping devices 10, 10' to be securely fastened to the pipe 32. FIG. 2 depicts a typical configuration in which the lighting fixtures 1 are hung in a theater or musical production.

Figure 3:
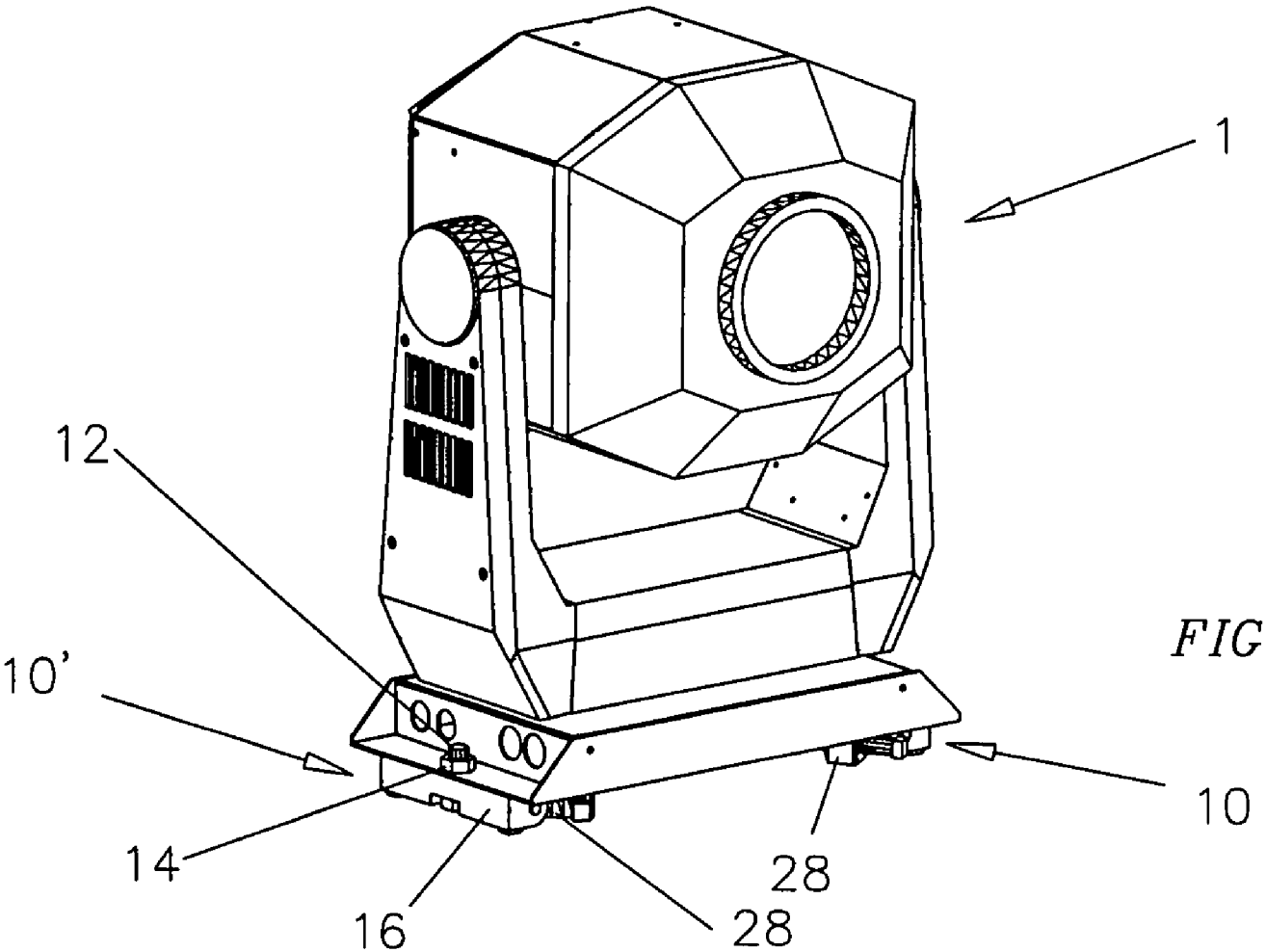
FIG. 3 is a perspective view of the present invention as used while supporting an automated light on a flat surface.

Referring to FIG. 3, the lighting fixture 1 and the clamping devices 10, 10' are shown with the clamping devices 10, 10' retracted to the horizontal position. This configuration is one that is used when the lighting fixtures 1 are to be placed on the floor of a stage. This position would also be one that would be used for testing the fixture 1 in a shop environment, or when the fixtures 1 are packed into a road case or box for transportation.

Figure 4:
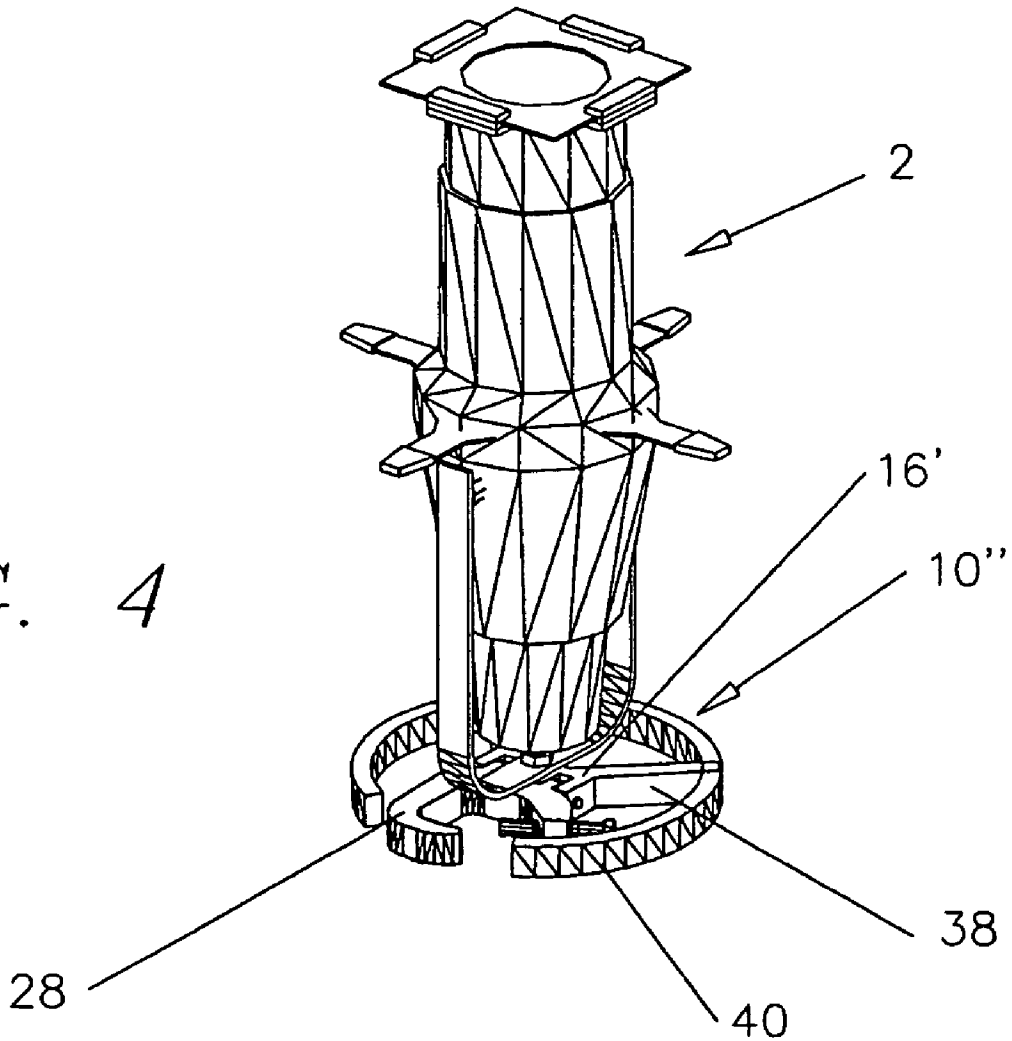
FIG. 4 is a perspective view of the present invention installed on a second type of light fixture and in a storage or floor position.
Figure 5:
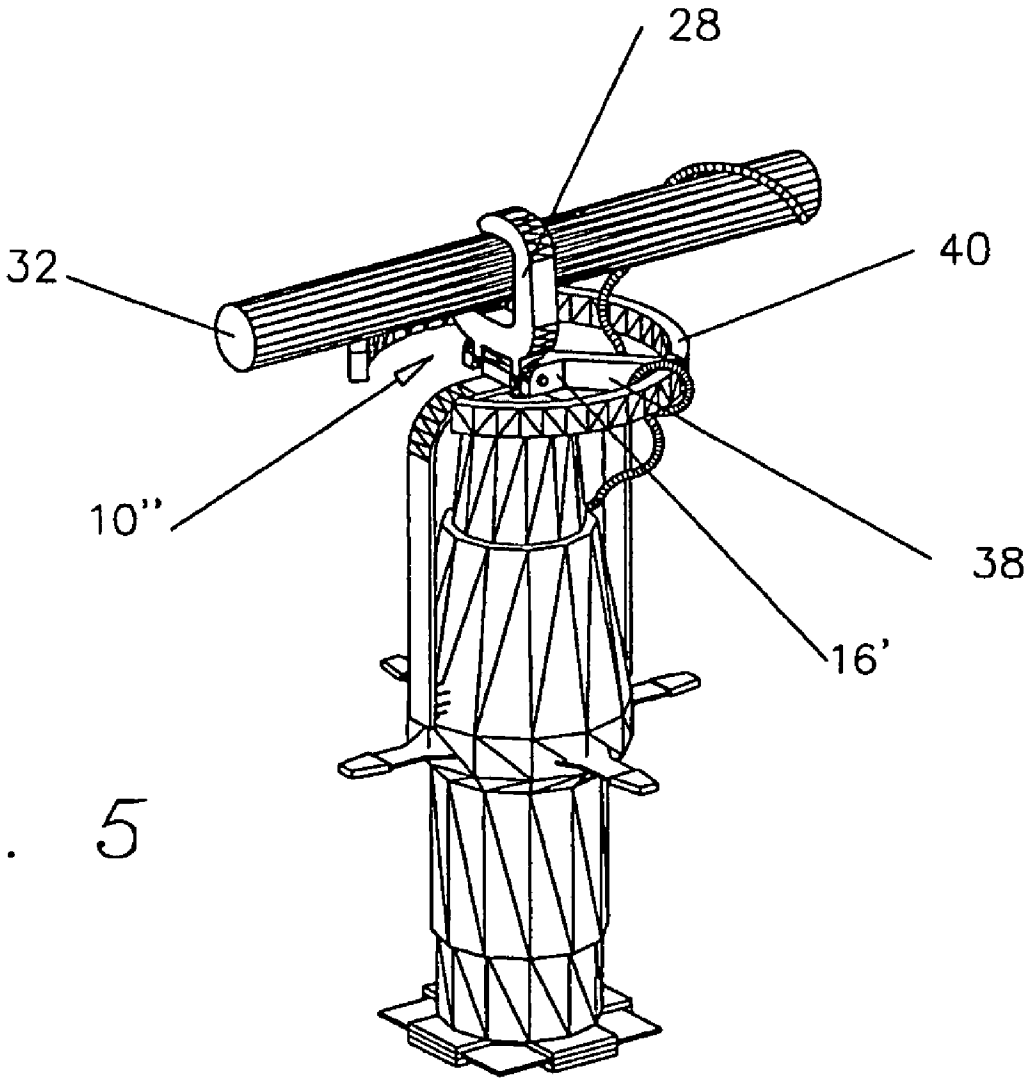
FIG. 5 is a perspective view of the clamping device of the present invention holding the second type of light on a pipe.

FIGS. 4 and 5 illustrate a first alternate embodiment of the clamping device 10" that is installed on a second type of light fixture 2. The second type of light fixture 2 has only a single mounting hole. To stabilize the fixture 2 when it is placed on the floor, a base 16' includes a plurality of support arms 38. In the preferred embodiment, there are three equally spaced support arms 38, with the clamp member 28 serving as one of the support arms 38. The other support arms 38 are affixed to a peripheral support ring 40. The support ring 40 allows the lighting fixture 2 to stand stably on the floor. The support ring 40 is also useful as an aid in dressing wiring away from the hot lighting fixture 2. FIG. 4 depicts the light fixture 2 in the floor or transportation position, and FIG. 5 shows the light fixture 2 as hung from a pipe 32. The clamping device 10" includes the same hinge structure as clamping devices 10, 10', which allows the main body 28 to swing through a ninety degree arc.

Any of the clamping devices 10, 10', 10", can be equipped with a lock or catch that fastens the clamp in the vertical and/or horizontal positions. A small amount of friction can be built into the hinge mechanism to accomplish the same purpose.

Further, any type of clamping mechanism can be used to secure the clamping member to the pipe. Some of these alternate mechanisms are disclosed in the cited prior art.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A lighting fixture clamping device comprising:

a main body, a hinge formed from a base section serving as a means to affix said clamping device to a lighting fixture and a first end of said main body, and means to affix said clamping device to an overhead pipe or rail, said means to affix said clamping device to an overhead pipe or rail including a securing means to secure said means to affix said clamping device to an overhead pipe or rail in a fixed position on said overhead pipe or rail; wherein said hinge mechanism provides a mechanism for said main body to swing through an arc of ninety degrees relative to said lighting fixture, said clamping device in a first position supporting a lighting fixture on a floor or the ground and minimizing storage space, and said clamping device swinging to a second position in which said clamping device is extended so that said clamping device is in position to secure said lighting fixture to the pipe or rail.

2. The clamping device of claim 1 wherein:

said clamping device further comprises foot pads attached to said base to increase stability of a light fixture when said clamping device is in said first position.

3. The clamping device of claim 1 wherein:

said hinge mechanism comprises at least one section of said base, at least one boss, and a pivot axle that passes through said at least one section of said base and said boss.

4. The clamping device of claim 1 wherein:

said clamping device further comprises a support ring affixed to said main body.

5. The clamping device of claim 4 wherein:

said clamping device further comprises at least one support arm connected to said base and to said support ring.

6. The clamping device of claim 1 wherein:

at least two units of said means to affix said clamping device to a light fixture are included in said clamping device.

7. The clamping device of claim 1 wherein:

said means to affix said clamping device to a light fixture folds inward about said hinge mechanism.

* * * * *